United States Patent [19]

Degois et al.

[11] 3,961,663

[45] June 8, 1976

[54] PROCESS OF EMPLOYING A SUBSTANCE IN PELLET FORM FOR NODULARIZING GRAPHITE IN LIQUID CAST IRON

[75] Inventors: Michel Louis Degois; Jean-Pierre Albert Maquaire, both of Point-a-Mousson, France

[73] Assignee: Pont-A-Mousson S.A., Nancy, France

[22] Filed: May 28, 1974

[21] Appl. No.: 473,976

[30] Foreign Application Priority Data

May 28, 1973 France ..... 73.19340
May 9, 1974 France ..... 74.16090

[52] U.S. Cl. ..... 164/58; 164/57
[51] Int. Cl.[2] ..... B22D 27/20
[58] Field of Search ..... 164/57, 58, 59, 55, 164/80

[56] References Cited

UNITED STATES PATENTS 3,703,922 11/1972 Dunks et al. ..... 164/57
3,851,700 12/1974 McAfee et al. ..... 164/57

FOREIGN PATENTS OR APPLICATIONS 1,089,574 11/1967 United Kingdom ..... 164/57
1,132,056 10/1968 United Kingdom ..... 164/55

*Primary Examiner*—Ronald J. Shore
*Attorney, Agent, or Firm*—Sughrue, Rothwell, Mion, Zinn & Macpeak

[57] ABSTRACT

A process of employing a substance for nodularizing graphite in molten cast iron which cast iron contains iron and a nodularizing agent, wherein the substance comprises pure iron and pure nodularizing agent which are in a powdered state and agglomerated together the process comprising pouring the molten cast iron into a mould and contacting the cast iron with the substance inside the mould.

4 Claims, 5 Drawing Figures

PROCESS OF EMPLOYING A SUBSTANCE IN PELLET FORM FOR NODULARIZING GRAPHITE IN LIQUID CAST IRON

The present invention relates to a substance for nodularizing graphite in liquid cast iron and to a process and device for employing such a substance.

It is known, for example from French Pat. No. 70 04 054, to place in the mould an addition substance in the form of plates or discs which are produced by compacting a mixture of spongy iron powder and an inoculating product. The latter may be graphite calcium carbide, calcium silicide or a ferro-silicon alloy which may contain additional elements such as, for example, magnesium. This known process concerns the inoculation of the cast iron to avoid the formation of harmful carbides and not the attaining of a spheroidal graphite cast iron, the usual inoculating proportions being distinctly smaller than the larger proportions required for nodularizing.

It is also known, for example, from French Pat. No. 69 24 353, to treat the liquid or molten iron in a mould by means of a nodularizing substance having for its function the rendering of the graphite in the solidified metal spheroidal, but this substance is in the form of an iron-silicon-magnesium alloy in the form of pieces, crushed aggregates or powder, or in an extruded or compact form.

When such a treating substance is employed in the form of an alloy containing silicon, if it is desired to nodularize the cast iron, the proportion of magnesium must be sufficiently high. Consequently, the proportion of silicon, which is contained in the iron-silicon-magnesium alloy and which depends on the proportion of iron and magnesium, may become excessive to the point of diminishing the mechanical characteristics of the cast parts, and above all to the point of creating slag which is difficult to retain. It is indeed known that it is the silicon brought by the inoculation into the cast iron which produces such slag. Notwithstanding the use of means for retaining this slag inside the casting passages of the moulds termed slag traps, it is not always possible to prevent entry of slag into the moulds.

In other words, when cast iron is to be nodularized by means of an inoculating-nodularizing iron-silicon-magnesium alloy, it is not possible to control the proportion of silicon as soon as the proportion of magnesium is imposed by the necessity to have the major part of the free graphite in the spheroidal form.

Moreover, the very violent, if not explosive and dangerous, reactions of the magnesium with the cast iron are known, and this motivates the use of magnesium in the aforementioned alloyed form.

Further, it is difficult to obtain a good distribution of the content of nodularizing agent in the cast iron and consequently a regular form of the spheroidal grahite in the matrix cannot be obtained and a regular structure of this matrix.

Therefore, an object of the present invention is to provide a nodularizing substance which, while it contains pure magnesium, i.e., non-alloyed magnesium, does permit both a nodularizing of the cast iron inside the mould and a controlling of the proportion of silicon optically introduced for inoculating the iron, independently of the proportion of magnesium, and therefore without employing an excess therein which is capable of creating slag.

According to the invention, this substance for nodularizing the graphite in the liquid cast iron, of the type containing iron and a nodularizing agent, comprises pure iron and pure agent both of which are in the powder state and agglomerated together.

In addition to the aforementioned advantages, this substance also has the considerable advantages of ensuring a homogeneous distribution in the cast iron which confers excellent mechanical properties on the cast parts and permits the treatment of small amounts of iron, for example, small series of spheroidal graphite cast parts.

In a particular embodiment of the invention, the nodularizing substance is agglomerated in the form of pellets, all of which contain the same predetermined content of nodularizing agent.

In another advantageous embodiment of the invention which results in a remarkable homogeneity in the content of residual nodularizing agent and a particular regularity in the form of the graphite and in the structure of the matrix, the nodularizing substance is agglomerated in the form of pellets comprising a plurality of groups of pellets in which the nodularizing agent content varies from one group to the other.

Another object of the invention is to provide an advantageous process for using said such a substance, comprising pouring the molten cast iron into the mould and putting it in contact with the substance inside the mould. If the substance is of the type of the aforementioned second embodiment, there is put at the head end in the path of the cast iron the group of pellets having the highest nodularizing agent content, the following groups succeeding each other in accordance with a decreasing order of their nodularizing agent content.

Another object of the invention is to provide a device for advantageously employing such a substance, this device comprising a mould whose pouring passage which leads to the moulding cavity has a constant section exceeding the section of the pellets.

Embodiments of the invention will now be described in the ensuing description by way of example with reference to the accompanying drawings in which.

The nodularizing substance employed in the first embodiment is in the proportion of 0.5 to 3% with respect to the weight of the cast iron and it comprises a mixture of fine particles of pure magnesium and pure iron agglomerated or bonded together in the form of pellets. The metallic powder of iron and magnesium employed comprises a mixture of 1 to 20%, and preferably 10%, by weight of magnesium and 80 to 99%, and preferably 90%, of iron. Indeed, on one hand, use of a higher magnesium content does not permit a homogeneous distribution within the molten metal since the reaction becomes excessively rapid and, on the other hand, a lower content has necessitates a considerable increase in the volume of pellets required. Moreover, the particle size of the powder is not immaterial since, in order to obtain a dissolving devoid of projections, it is advisable to have particles which are as fine as possible, and for this purpose a particle size range of 0 to 500 microns, preferably 100 to 300 microns, is chosen.

The iron and magnesium powder is compacted in a press under a pressure of at least 1 metric ton per square centimeter, and preferably several metric tons per square centimeter, for example in the form of pellets or thick discs having a diameter of between 0.5 and 5 cm and a thickness of between 0.5 and 5 cm. The powder may also be compacted into a shape closer to a sphere, for example in the shape of a cushion whereby the stack of pellets is more stable with respect to the stream of molten cast iron.

Figure 1:
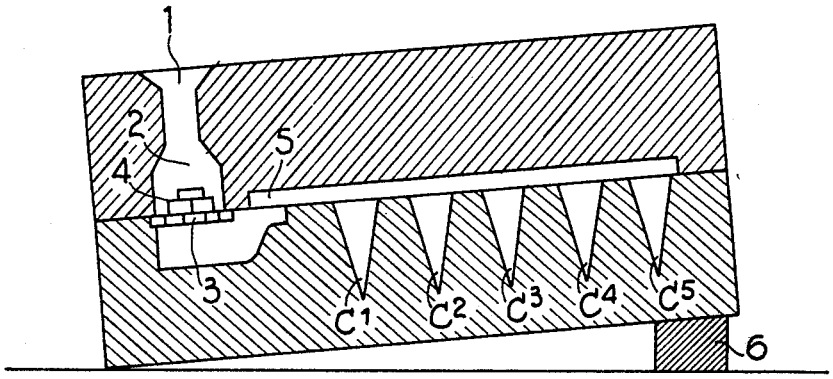
FIG. 1 is a diagrammatic sectional view of an experimental mould for employing a substance according to the invention.

The process for employing this substance comprises pouring the iron into the mould and causing it to flow on and around the pellets. When there is employed for this purpose the mould shown in FIG. 1, the iron first enters the pouring basin then the pouring sprue 2 at the bottom of which there is placed a support, for example, comprising a filter 3, on which two pellets 4 are disposed. Upon contact with the iron, the temperature of the pellets rises until they react in a moderate manner.

The reaction due to the addition of the magnesium to the iron achieved is thus progressive and the regularity of the supply of magnesium may be revealed in the following manner.

After having passed through the filter 3, the iron is directed by means of a channel 5 to roughly vertical wedge-shaped cavities $C^1$, $C^2$, $C^3$, $C^4$ and $C^5$ disposed in the form of spikes with respect to this channel, the mould resting on a block 6 adjacent the cavity $C^5$ remote from the entrance so that the iron enters in succession the cavities $C^1$ to $C^5$ one after the other. The magnesium contents are thereafter measured in the parts cast in each one of these cavities in starting with the corner $C^1$ which is the nearest to the entrance and therefore contains the iron at the start of the pouring. Two tests were carried out separately, one with a conventional nodularizing substance, the other with a substance according to the invention. The results obtained are shown in the following table.

| | Magnesium content (%) | | | | |
|---|---|---|---|---|---|
| Cavities | $C^1$ | $C^2$ | $C^3$ | $C^4$ | $C^5$ |
| Test I (Conventional) | 0.040 | 0.035 | 0.028 | 0.025 | 0.015 |
| Test II (Invention) | 0.035 | 0.033 | 0.030 | 0.022 | 0.020 |

Figure 2:
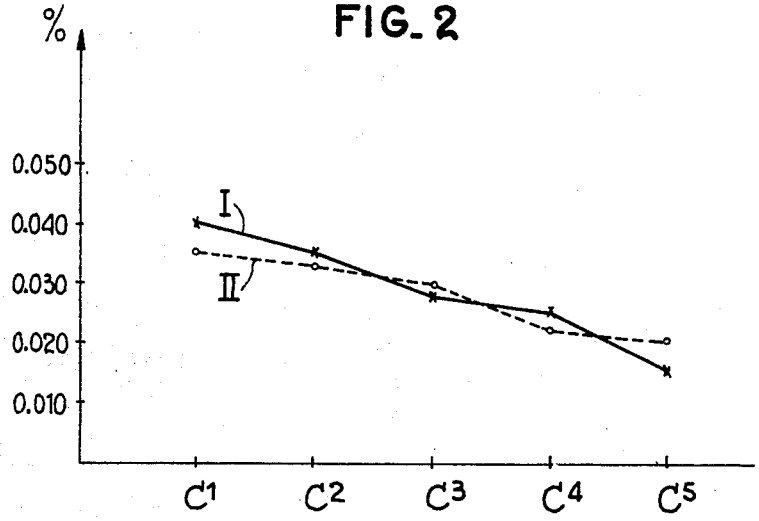
FIG. 2 is a diagram in which a curve representing the magnesium content obtained in the cast iron shows the advantageous features of a substance according to a first embodiment of the invention.

The curves representing the experimental measurements are shown in FIG. 2, one curve, in full line, corresponding to the test I employing a conventional substance and the other, in dotted line, corresponding to the test II employing the substance according to the invention. It will be observed that the mean slope of curve II is less than that of curve I which shows not only the evenness of the distribution of the magnesium but also the lesser effect of loss of the nodularizing effect with respect to time. Note that the experimental pouring or casting times are longer than the normal casting times under industrial conditions so that the utilizable portion of the curve is located mainly in its first part.

By way of a modification, the particles of iron may be replaced by a ferro-silicon alloy powder which has the advantage of inoculating the iron at the same time as the nodularizing reaction. Moreover, the particles of magnesium may be replaced by calcium or cerium powder or a powder of another nodularizing rare earth agent.

Figure 3:
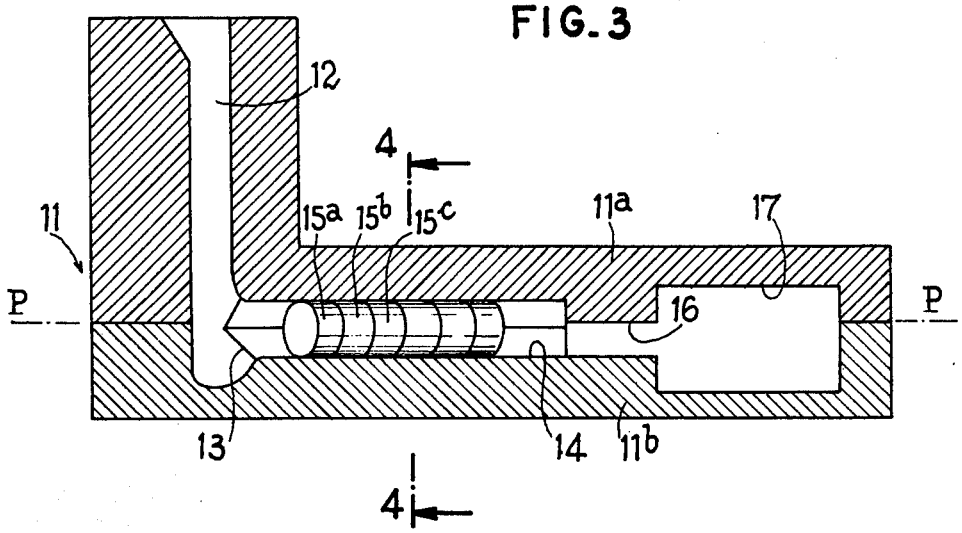
FIG. 3 is a longitudinal sectional view of a foundry mould for employing a nodularizing substance according to a second embodiment of the invention.
Figure 4:
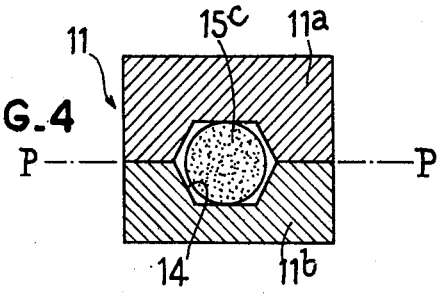
FIG. 4 is a cross-sectional view taken on line 4—4 of FIG. 3.

According to the embodiment shown in FIG. 3, the molten iron enters the interior of a mould 11 — which is of cast material and comprises an upper part $\mathbf{11}^a$ and a lower part $\mathbf{11}^b$ which have a horizontal joint plane P—P — through a vertical pouring gate 12 whose bottom has a lateral pouring hole 13 which is arranged symmetrically with respect to the plane P—P and into which opens a horizontal prismatic channel 14 which is also disposed symmetrically with respect to the plane P—P and whose cross-section is approximately hexagonal as a result of the draft required for stripping the cast mould when the two mould halves are manufactured.

Pellets $\mathbf{15}^a$, $\mathbf{15}^b$, $\mathbf{15}^c$ etc.. are placed in succession in the passage 14, these pellets being in the form of sections of a cylinder whose diameter is substantially equal to the height of the section of the passage 14 and comprising an agglomerated magnesium and iron powder in which the magnesium content varies from one pellet to the other, for example from 5 to 75%, the balance being iron. These pellets are disposed in contact with each other along the axis of the passage 14 and are held in position by the pressure of the upper part $\mathbf{11}^a$ and lower part $\mathbf{11}^b$ of the mould.

The pouring channel 14 has at the end thereof opposed to the pouring hole $\mathbf{13}^a$ constricted section 16 so that the slag which might be produced by the interaction of the molten metal on the pellets, is arrested by the throttling afforded by this constriction. The molten metal thereafter spreads out in the mould cavity 17 which corresponds to the part to be moulded and is also disposed on each side of the plane P—P.

The treating pellets $\mathbf{15}^a$, $\mathbf{15}^b$, $\mathbf{15}^c$ . . . are placed in the lower half of the channel 14, the upper part $\mathbf{11}^a$ of the mould is placed in position and then the molten iron is poured through the pouring gate 12. The iron flows in the channel 14 between the walls of the latter and the pellets so that, upon contact with the pellets, the iron is progressively treated in such manner as to render the graphite contained therein spheroidal. The section of the free passage between the walls of the passage and the pellets is determined in accordance with the desired rate of flow of the molten metal.

The following example of application illustrates in a more precise manner the advantages obtained.

A mould is used which has a structure identical to that shown in FIG. 3, except that the cavity 17 is eliminated so that the iron flows freely out of the mould into copper crucibles adapted for the analysis of the treated iron. In the channel 14, there are introduced 16 treating pellets having the following characteristics:

one pellet having 75% of magnesium;
two pellets having 10% of magnesium;
13 pellets having 5% of magnesium;
the balance being iron in all the pellets.

The pellet containing 75% of magnesium is placed at the upstream end of the stack of pellets so as to treat the crude molten metal rapidly then the following pellets are arranged in the decreasing order of their magnesium content. The pouring temperature is between 1400° and 1420°C.

The conditions are therefore substantially less favorable than those obtaining in the moulding of industrially-produced parts since by operating with a free flow of metal into crucibles no benefit is had of the normal subsequent agitation or mixing in the cavity 17 which ensures a better homogeneity, this being even more true in this case because the magnesium has the time to be diffused within the cast part in the course of the cooling.

The sampling crucibles then permit the determination of the residual magnesium content of the treated metal as a function of the pouring time measured from the start of the pouring of the iron in the pouring gate including the time for analysing the contents of the crucible (of the order of 2/100 minute) and the following results are obtained:

| | | | | | |
|---|---|---|---|---|---|
| Pouring Time 1/100 minute | 5 | 10 | 15 | 20 | 15 |
| Mg content thousandths % | 24 | 22 | 22 | 22 | 24 |

Figure 5:
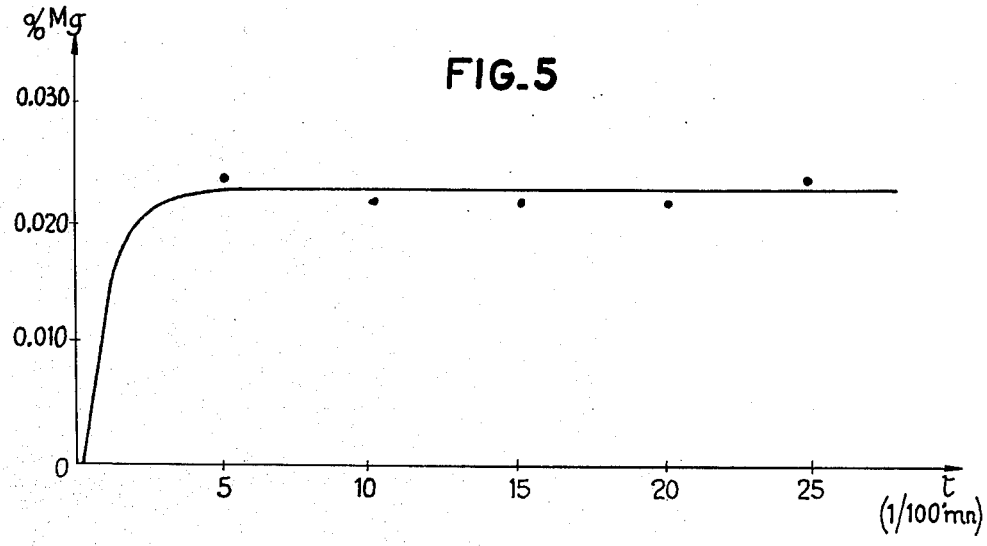
FIG. 5 is a diagram in which the curve represents the residual magnesium content obtained in the cast iron as a function of the casting time, this curve showing the advantageous features of the substance according to the second embodiment of the invention.

Thus, it is clear from FIG. 5 that the magnesium content is substantially constant between 0.022 and 0.024%. This remarkable result shows that the parts cast under similar conditions have a good homogeneity of magnesium content and that the form of the graphite and the structure of the matrix are particularly even or regular.

It will be understood, as in the first embodiment, that it is possible in this second embodiment to replace the magnesium by calcium, cerium or another rare earth. Likewise, the particle size of the powders of iron and nodularizing agent is preferably between 0 and 500 microns, and particularly advantageously between 100 and 300 microns. The pellets are preferably agglomerated or bonded in a press under a pressure exceeding 1 metric ton per square centimeter.

We claim:

1. A process for nodularizing graphite in molten cast iron which contains iron and a nodularizing agent which comprises pouring said molten cast iron in a mould and contacting said cast iron with a substance including pure iron and pure nodularizing agent in a powdered state and agglomerated together; said substance being in the form of pellets arranged in a plurality of groups of pellets whose nodularizing agent content varies from one group to the others, and said contacting step including placing at the upstream end of the path of the poured molten iron the group of pellets having the highest nodularizing agent content and placing in downstream sequence groups of pellets having a decreasing order of nodularizing agent content.

2. A process for nodularizing graphite in molten cast iron which contains iron and a nodularizing agent which comprises pouring said molten cast iron in a mould and contacting said cast iron with a substance including pure iron and pure nodularizing agent in a powdered state and agglomerated together; said nodularizing agent being magnesium; said substance being employed in an amount of 0.5 to 3% by weight of said cast iron and comprising 10% by weight magnesium and 90% by weight iron; and said substance being in the form of pellets, one pellet having 75% by weight magnesium, two pellets having 10% by weight magnesium, and thirteen pellets having 5% by weight magnesium.

3. A process for nodularizing graphite in molten cast iron which contains iron and a nodularizing agent which comprises pouring said molten cast iron in a mould and contacting said cast iron with a substance including pure iron and pure nodularizing agent in a powdered state and agglomerated together; said substance being in the form of pellets arranged in a plurality of groups of pellets whose nodularizing agent content varies from one group to the other; said nodularizing agent being magnesium and the magnesium content of said groups of pellets ranging from 5 to 75 weight %; and said contacting step including placing at the upstream end of the path of the poured molten iron the group of pellets having the highest nodularizing agent content and placing in downstream sequence groups of pellets having a decreasing order of nodularizing agent content.

4. A process for nodularizing graphite in molten cast iron which contains iron and a nodularizing agent which comprises pouring said molten cast iron in a mould and contacting said cast iron with a substance including pure iron and pure nodularizing agent in a powdered state and agglomerated together; said nodularizng agent being magnesium; said substance comprising 10% by weight magnesium and 90% by weight iron; and said substance being in the form of pellets, one pellet having 75% by weight magnesium, two pellets having 10% of magnesium and thirteen pellets having 5% of magnesium, and said contacting step including placing at the upstream end of the path of the poured molten iron the group of pellets having the highest nodularizing agent content and placing in downstream sequence groups of pellets having a decreasing order of nodularizing agent content.

* * * * *